US011143395B2

(12) United States Patent
Van Delden et al.

(10) Patent No.: US 11,143,395 B2
(45) Date of Patent: Oct. 12, 2021

(54) LIGHTING MODULE AND LIGHTING KIT

(71) Applicant: SIGNIFY HOLDING B.V., Eindhoven (NL)

(72) Inventors: Martinus Hermanus Wilhelmus Maria Van Delden, Venlo (NL); Silvia Maria Booij, Eindhoven (NL); Peter Tjin Sjoe Kong Tsang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/958,718

(22) PCT Filed: Dec. 18, 2018

(86) PCT No.: PCT/EP2018/085422

§ 371 (c)(1),
(2) Date: Jun. 28, 2020

(87) PCT Pub. No.: WO2019/134820

PCT Pub. Date: Jul. 11, 2019

(65) Prior Publication Data

US 2021/0010670 A1 Jan. 14, 2021

(30) Foreign Application Priority Data

Jan. 2, 2018 (EP) ..... 18150007

(51) Int. Cl.
*F21V 33/00* (2006.01)
*F21V 5/02* (2006.01)
(Continued)

(52) U.S. Cl.
CPC ..... *F21V 33/0056* (2013.01); *F21V 5/02* (2013.01); *H04R 1/2876* (2013.01); *F21Y 2105/10* (2016.08)

(58) Field of Classification Search
CPC ..... F21V 33/0056; F21V 5/02; F21V 33/006; F21V 33/0052; F21V 33/0004;
(Continued)

(56) References Cited

U.S. PATENT DOCUMENTS 3,665,177 A 5/1972 Brown et al.
9,147,390 B2 9/2015 Swinkels et al.
(Continued)

FOREIGN PATENT DOCUMENTS

WO 2013001430 A1 1/2013
WO 2013038292 A1 3/2013

OTHER PUBLICATIONS https://en.wikipedia.org/wiki/Micro_perforated_plate, "Micro perforated plates".

*Primary Examiner* — Bao Q Truong
(74) *Attorney, Agent, or Firm* — Daniel J. Piotrowski

(57) ABSTRACT

Disclosed is a lighting module (10) comprising a carrier (20) having a major surface (21) including a plurality of first regions (23) and a plurality of second regions (25), each second region being adjacent to a first region. The lighting module also has a plurality of light engines (40), each light engine being located in a first region of said carrier, and an optically transmissive light exit structure (50) facing the major surface and being spatially separated therefrom. Each first region is covered by a separate cover (30) that is optically transmissive and acoustically reflective. Each cover has a surface portion with a surface normal (31) under a non-zero angle (θ) with the surface normal (51) of the light exit structure so that it is shaped to reflect sound waves (33) towards an adjacent second region (25). Each second region has an acoustically absorbent member (35) arranged to
(Continued)

absorb said reflected sound waves. Also disclosed is a lighting kit (100) comprising a plurality of such lighting modules.

9 Claims, 5 Drawing Sheets

(51) Int. Cl.
*H04R 1/28* (2006.01)
*F21Y 105/10* (2016.01)

(58) Field of Classification Search
CPC ... F21V 5/04; F21V 7/24; F21V 13/02; F21V 13/04; F21V 99/00; H04R 1/2876; H04R 1/2869; F21Y 2105/10; F21Y 2115/10; F21S 8/04
See application file for complete search history.

(56) References Cited

U.S. PATENT DOCUMENTS

| | | | | |
|---|---|---|---|---|
| 10,030,850 | B2 * | 7/2018 | Vissenberg | F21V 3/08 |
| 2013/0201690 | A1 | 8/2013 | Vissenberg et al. | |
| 2015/0136521 | A1 | 5/2015 | Swinkels et al. | |
| 2021/0025567 | A1 * | 1/2021 | Van Delden | F21S 8/026 |

* cited by examiner

LIGHTING MODULE AND LIGHTING KIT

CROSS-REFERENCE TO PRIOR APPLICATIONS

This application is the U.S. National Phase application under 35 U.S.C. § 371 of International Application No. PCT/EP2018/085422, filed on Dec. 18, 2018, which claims the benefit of European Patent Application No. 18150007.5, filed on Jan. 2, 2018. These applications are hereby incorporated by reference herein.

FIELD OF THE INVENTION

The present invention relates to a lighting module configured to absorb acoustic waves.

The present invention further relates to a lighting kit comprising a plurality of such lighting modules.

BACKGROUND OF THE INVENTION

Advances in lighting technology such as the introduction of solid state lighting (SSL), e.g. as implemented by light emitting diode (LED)-based lighting modules, has transformed the lighting field. For example, lighting panels having very large surface areas, e.g. surface areas of several square meters ($m^2$), such as panels having a surface area in the range of 2-20 $m^2$ by way of non-limiting example, are now available that can transform the lighting experience in enclosed spaces such as large rooms, offices, halls and the like. Such panels in some application domains are provided as at least part of the ceiling of such enclosed spaces, where they provide substantially homogeneous lighting emanating from parts of the ceiling defined by such panels.

One particular challenge associated with such (large area) lighting modules is that in addition to their optical function, they also need to perform an acoustic dampening function in order to preserve the desired acoustics in the enclosed space in which they are fitted. Solutions exist in which such acoustic dampening is provided using glass fibre-based carrier plates that are held in place by a metal frame. This assembly forms the housing of the light-engine. Within such a housing, many LEDs may be suspended such that the LEDs face the highly reflective acoustic panels, thereby indirectly illuminating the light exit window of the lighting module, which may be defined by an acoustically transparent member such as a woven or knitted fabric that allows the sound waves to travel through the light exit window such that they can be dampened by the glass fibre panels within the housing. Materials such as plastics and glass are unsuitable as the light exit window material of choice due to their high acoustic reflectivity. However, the optical reflectivity of typical glass fibre panels is limited to 80-85%, which is suboptimal in particular in large area applications. This may be improved using advanced coatings such as sol-gel coatings, but this often is cost-prohibitive.

US2015/0136521 A1 discloses an acoustic panel comprising a plurality of parallel-arranged elongated cavities, wherein each cavity has a first cavity wall and a second cavity wall tapering to a cavity back end and defining a cavity opening angle (Y) having a value in the range of $0° < Y < 90°$, wherein the first cavity wall and the second cavity wall comprise a light-reflective material, wherein each elongated cavity at the cavity back end of the elongated cavity accommodates a light source having a light exit surface, wherein the first cavity walls hide the light exit surfaces of the light sources when the acoustic panel is viewed along a normal to the acoustic panel, and wherein the acoustic panel further comprises sound reducing material. Although this solution provides excellent acoustic dampening in a cost-effective manner, its optical performance is still not optimal due to a large fraction of the light emitted by the light sources being incident onto the cavity walls, causing optical losses.

SUMMARY OF THE INVENTION

The present invention seeks to provide a cost-effective lighting module configured to effectively absorb acoustic waves whilst also having good optical performance.

The present invention further seeks to provide a lighting kit comprising a plurality of such lighting modules.

According to an aspect, there is provided a lighting module comprising a carrier having a major surface including a plurality of first regions and a plurality of second regions, each second region being adjacent to a first region. The lighting module further comprises an optically transmissive light exit structure facing the major surface and being spatially separated therefrom. Each first region of said carrier has at least one light engine. Each first region is covered by a separate cover that is optically transmissive and acoustically reflective. Each cover has a surface portion with a surface normal under a non-zero angle with the surface normal of the light exit structure so that it is shaped to reflect sound waves towards an adjacent second region. Each second region of said carrier has an acoustically absorbent member arranged to absorb said reflected sound waves.

In the context of the present invention, the term "light engine" refers to a light source comprising one or more solid state lighting elements, such as LEDs, thereby providing a particularly energy-efficient lighting module.

Embodiments of the present invention are based on the insight that optically transmissive covers made of an acoustically reflective material, e.g. polymers or plastics such as poly (methylmethacrylate) (PMMA), polyethylene terephthalate (PET), polycarbonate (PC) and so on, glass, and other suitable materials, may be used to effectively deflect impending sound waves towards the second regions of the lighting module, whilst allowing a large portion of the light emitted by the light engines to pass through the cover and exit the lighting module, e.g. through a light exit surface, without having to be reflected by the acoustically absorbent member, thereby achieving excellent optical and acoustic characteristics without requiring the acoustically absorbent member to cover the entire major surface of the lighting module, thereby reducing its cost.

To further improve the optical efficiency of the lighting module, the acoustically absorbent member may have a light-reflective coating such that light generated by the light engines that is incident on the acoustically absorbent members in the second regions is reflected rather than absorbed.

The acoustically absorbent member may comprise at least one of a foam material, e.g. a melamine foam, glass wool and a micro-perforated member such as a micro-perforated plate, which may be folded. Such a member may for example be a metal plate with small holes, e.g. perforations, carrying a high reflective optical coating or a high reflective white plastic material such as MCPET as marketed by the Furukawa electric group, Japan or Reftelas™ as marketed by the Sekisui Plastics company, Japan.

The carrier also may be at least partially made of an acoustically absorbent material to further enhance the acoustic dampening properties of the lighting module.

In a particular embodiment, each first region comprises an acoustically absorbent recess housing the at least one light engine such that sound waves entering the recess are absorbed, thereby further improving the acoustic properties of the lighting module. In order to further improve the optical performance of the lighting module, each acoustically absorbent recess may have a light-reflective inner surface to reduce light losses caused by the absorption of light by the walls of the acoustically absorbent recesses.

In some embodiments, each cover covers a plurality of light engines, e.g. in case of elongate first regions such as elongate channels, each such elongate first region housing a linear array of light engines. Alternatively, each light engine is covered by a separate cover, e.g. in case of first and second regions arranged in a checkerboard pattern, wherein each first region comprises one light engine. In this embodiment, each cover may be a multi-faceted cover that scatters incident sound waves into multiple directions, i.e. towards multiple adjacent second regions in which the acoustically absorbent material is located. For example, each cover may have a three-sided or four-sided pyramidal shape although other polygonal shapes, conical shapes, baffled plates and so on may also be used.

The light exit surface is an optically transmissive light exit structure such as a cloth or a micro-perforated foil facing and spanning the major surface and being spatially separated therefrom in order to obscure the internals of the lighting module from direct view, thereby enhancing the aesthetic appearance of the lighting module. Such a light exit structure may further act as a diffuser to further tune the optical performance of the lighting module.

In order to deflect sound waves that travel into the lighting module through the light exit structure, each cover has at least one surface region having a surface normal under a non-zero angle with the surface normal of said light exit structure such that such incident sound waves are deflected towards the second regions in which the acoustically absorbing material is located.

The plurality of first regions and the plurality of second regions may be arranged on the major surface in a regular pattern, such as for example a striped or zebra pattern, a checkerboard pattern, a honeycomb pattern and so on.

In accordance with a further aspect of the present invention, there is provided a lighting kit comprising a plurality of lighting modules of any of the herein described embodiments, wherein the lighting modules are configured to be coupled to each other. In this manner, large area lighting panels may be constructed in a modular manner by combining a plurality of the lighting modules according to one or more embodiments of the present invention, thereby significantly reducing the manufacturing complexity of such large area lighting panels. What is more, the sound absorbing characteristics of such lighting panels can be made directionally independent by assembly of such lighting panels using lighting modules in different orientations within the lighting panel, e.g. using lighting modules having an arrangement of first and second regions in a striped or zebra pattern in which the orientation of neighboring lighting modules within the panel are rotated relative to each other by 90°.

Such a modular lighting kit may further comprise a cloth for spanning across the lighting modules when coupled together, e.g. to form a lighting panel, in order to obscure said lighting modules from direct view, thereby obviating the need for individual lighting modules to comprise a previously explained light exit structure such as a cloth.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
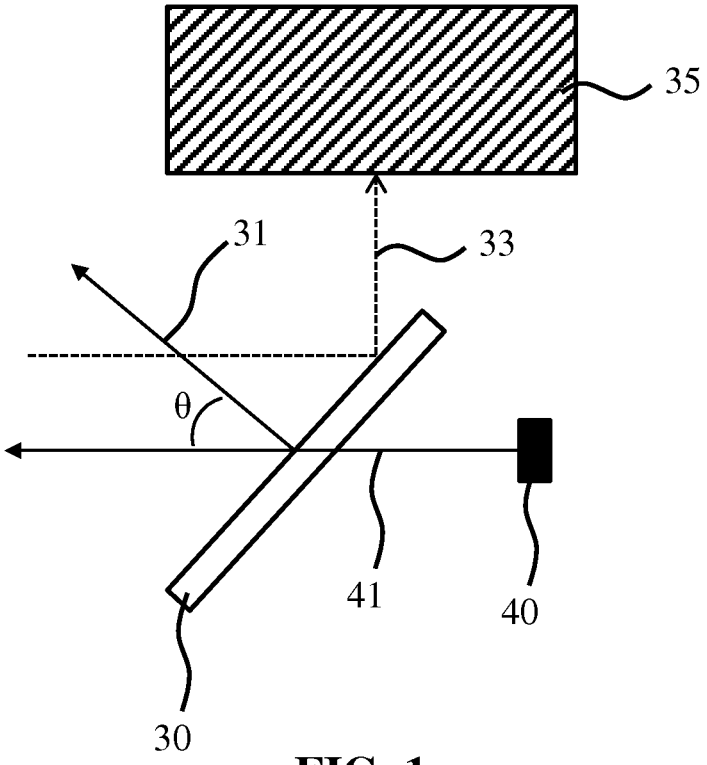
FIG. 1 schematically depicts the operational principle of the lighting module according to embodiments of the present invention.

It should be understood that the Figures are merely schematic and are not drawn to scale. It should also be understood that the same reference numerals are used throughout the Figures to indicate the same or similar parts.

FIG. 1 schematically depicts a top view of the internals of a lighting module 10 according to embodiments of the present invention explaining its operational principle. The lighting module 10 comprises a plurality of light engines 40 (of which for the sake of clarity only one is shown in FIG. 1) such as one or more SSL elements, e.g. LEDs that are arranged to direct their luminous output towards a light exit structure 50 such as a light exit window of the lighting module 10 through a light transmissive cover 30 of the light engine 40, which light transmissive cover 30 may be transparent, translucent or diffusive. The light transmissive cover 30 is made of a material that has a high acoustic reflectivity, for example an acoustic reflectivity of at least 70%, preferably of at least 80%, more preferably of at least 90%, which percentage expresses the fraction of sound waves 33 incident on the light transmissive cover 30 that deflect the sound waves 33 in another direction. The light transmissive cover 30 may be made of any material having optically transmissive and acoustically reflective properties, e.g. polymers such as PMMA, PET, PC and the like or glass materials. The light transmissive cover 30 is typically shaped such that a surface portion of the light transmissive cover 30 has a surface normal 31 under a non-zero angle θ with the surface normal 51 of the light exit structure 50 such that sound waves 33 incident on this surface portion are deflected to a region adjacent to the light engine 40 in which an acoustically absorbent member 35 is located such that the deflected sound waves 33 are absorbed by this material. For example, the angle θ typically is larger than 0° and smaller than 90°, and may lie in a range of 10-80°, a range of 20-70°, or a range of 30-60°.

In this manner, the lighting module 10 has a plurality of first regions, each first region housing one or more light engines 40, each first region being adjacent to a second region comprising the acoustically absorbent member 35. Consequently, due to the acoustically reflective nature of the cover(s) 30, the acoustic absorbance or dampening of the light module 30 is comparable with prior art light modules in which the entire surface is covered in such an acoustically absorbent member 35. This is because the acoustically absorbent member 35 has multiple surfaces capable of absorbing sound waves 33; for example, a rectangular bar-shaped acoustically absorbent member 35 has three exposed surfaces that can receive sound waves 33, i.e. a first surface facing the light exit structure 50 that can absorb sound waves 33 passing through the light exit structure 50 that are directly incident on the first surface and a pair of side surfaces extending from the first surface that can absorb deflected sound waves by adjacent light transmissive covers 30.

The light transmissive cover 30 may have a continuous surface facing the light exit structure 50, e.g. a conical surface or another shape curved surface, or may have a multi-faceted surface facing the light exit structure 50 such as a polygonal surface, e.g. an elongated triangular surface, a 3-sided or 4-sided pyramidal surface, a hexagonal tiled surface, an octagonal tiled surface, and so on. In yet another embodiment, the light transmissive cover 30 is formed as a baffled plate. Other suitable shapes for the light transmissive cover 30 will be immediately apparent to the skilled person.

Each first region is covered by a separate cover 30 that is optically transmissive and acoustically reflective. The light transmissive cover 30 may cover a plurality of light engines 40, e.g. a plurality of SSL elements, which may be arranged as a linear array of SSL elements, or alternatively each light engine 40 may be covered by a separate light transmissive cover 30. The light transmissive cover 30 may operate as a mixing chamber for the light generated by the one or more light engines 40 it covers and may further perform an optical function, e.g. act as a diffuser, lens, collimator or the like of the light output produced by the one or more light engines 40 it covers.

The acoustically absorbent member 35 may have any suitable shape, such as a block having a rectangular cross-section. Other cross-sectional shapes are equally feasible. In an embodiment, the cross-sectional shape of the acoustically absorbent member 35 is tuned to maximize the width of the acoustic wavelength spectrum it can absorb. For example, the cross-sectional shape of the acoustically absorbent member 35 may have a bar shape, trapezoidal shape, wedge shape or the like for this purpose. The acoustically absorbent member 35 may be formed from multiple acoustically absorbent material portions for this purpose. For instance, a rectangular bar-shaped acoustically absorbent member 35 formed from opposing wedge portions will have different acoustic absorption characteristics compared to a rectangular bar-shaped acoustically absorbent member 35 formed from a single piece of acoustically absorbent material.

The acoustically absorbent member 35 may comprise one or more acoustically absorbent materials, which may be any suitable material capable of effectively absorbing sound waves 33. Many of such materials are well-known per se, such as fibrous materials that are commonly deployed in traditional acoustic tiles, such as glass wool, foam-based materials such as a melamine foam, polyurethane foam, and so on, as well as micro-perforated plates. Such micro-perforated plates may have a surface area of which about 0.2-0.5% is perforated with microscopic holes having a diameter in a range of 0.05-0.5 mm although other dimensions are of course equally feasible. Such micro-perforated plates may be folded in order to achieve the desired dimensions of the acoustically absorbent member 35. The acoustically absorbent material, e.g. the micro-perforated plate or any other acoustically absorbent material, may be filled with a substance, e.g. glass wool, which increases the acoustic absorbance of the acoustically absorbent material to further improve the acoustic performance of the lighting module 10. The acoustically absorbent member 35 preferably is covered by a light-reflective coating, e.g. a white paint coating or a reflective foil, in order to minimize light losses of light generated by the light engines 40 that is incident on the acoustically absorbent member 35.

In an embodiment, the light engines 40 are solid state lighting elements such as LEDs. The light engines 40 may be arranged to directly or indirectly illuminate the light transmissive cover 30. In case of such indirect illumination, the light module 10 may comprise an arrangement of reflectors or reflective surfaces, e.g. of a cavity in which the light engine 40 is housed, which redirect the luminous output distribution of the light engines 40 towards their light transmissive cover 30. Preferably, the light engines 40 are arranged in a direct lit arrangement to optimize the optical performance of the light module 10.

Figure 2:
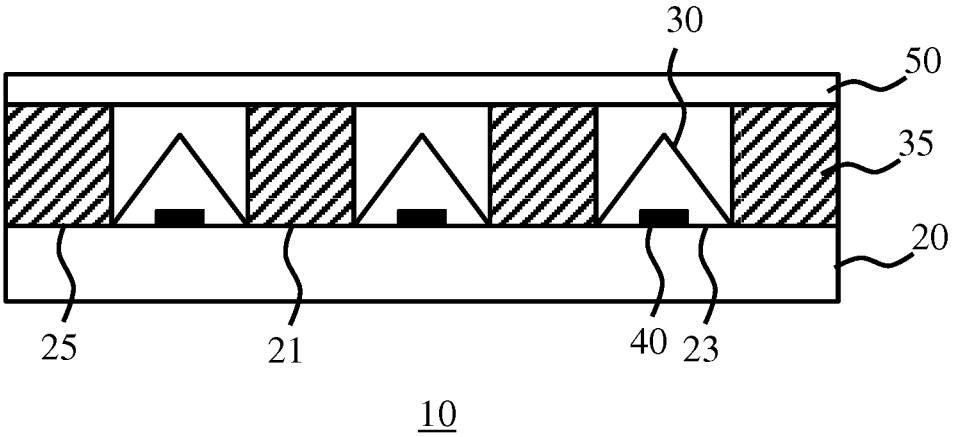
FIG. 2 schematically depicts a cross-sectional view of a lighting module according to an embodiment.

FIG. 2 schematically depicts a cross-sectional view of a lighting module 10 according to an example embodiment. The lighting module 10 comprises a carrier 20 having a major surface 21 comprising a plurality of first regions 23 in each of which one or more light engines 40 are positioned, i.e. carried by the carrier 20, with each first region 23 comprising at least one adjacent second region 25 carrying an acoustically absorbent member 35. Each first region 23 further comprises a light transmissive cover 30 covering the one or more light engines 40 present in that first region 23 such that the light emitted by the light engines 40 passes through the light transmissive cover 30 and exits the lighting module 10 through its light exit structure 50 opposite the first major surface 21 of the carrier 20. The carrier 20 may be made of or comprise any suitable materials, e.g. acoustically reflective materials such as metal or wood, acoustically absorbent materials such as glass wool, and so on. The carrier may be a solid structure, e.g. a continuous metal or wood panel, or an open structure, e.g. a metal frame or the like.

The light exit structure 50 may be an aperture in some embodiments or in alternative embodiments may comprise an acoustically transmissive member such as a cloth or the like such that the internals of the lighting module 10 are obscured from direct view by the acoustically transmissive member defining the light exit structure 50 whilst sound waves 33 can penetrate the lighting module 10 through the acoustically transmissive member and be absorbed either directly by the one or more acoustically absorbent members 35 or can be reflected onto the one or more acoustically absorbent members 35 by the one or more light transmissive covers 30 as explained in more detail above. In case of a light exit structure 50 comprising such a cloth, the cloth may be spanned across the entire surface of the lighting module 10 as will be understood by the skilled person.

Alternatively, as will be explained in further detail below, a plurality of lighting modules 10 may be provided as a lighting kit in which the lighting modules 10 may be combined to form a large area lighting apparatus, e.g. a lighting panel having a surface area of several square meters, in which case such a cloth may be spanned across the assembled lighting panel rather than across individual lighting modules 10. Such a large area lighting apparatus can be built up by similar lighting modules 10, e.g. lighting modules 10 having a tile shape with dimensions such as 30×30, 60×60, 30×60, 30×120 cm or any other suitable dimension, which has the advantage that such a large area lighting apparatus can be assembled in a more straightforward manner whilst maintaining a uniformly lit light exit surface, such as a light exit surface defined by a cloth spanned across the assembled lighting modules 10. In order to facilitate the assembly of such a modular lighting apparatus, each lighting module 10 may be provided with a mating mechanism, such as a tongue and groove mechanism, a male-female click mechanism or the like that facilitates the coupling together of individual lighting modules 10. For example, such a mating mechanism may be provided on one or more of the side surfaces defining the housing of the lighting module 10. As such mating mechanisms are well-known per se, they will not be explained in further detail for the sake of brevity only.

Figure 3:
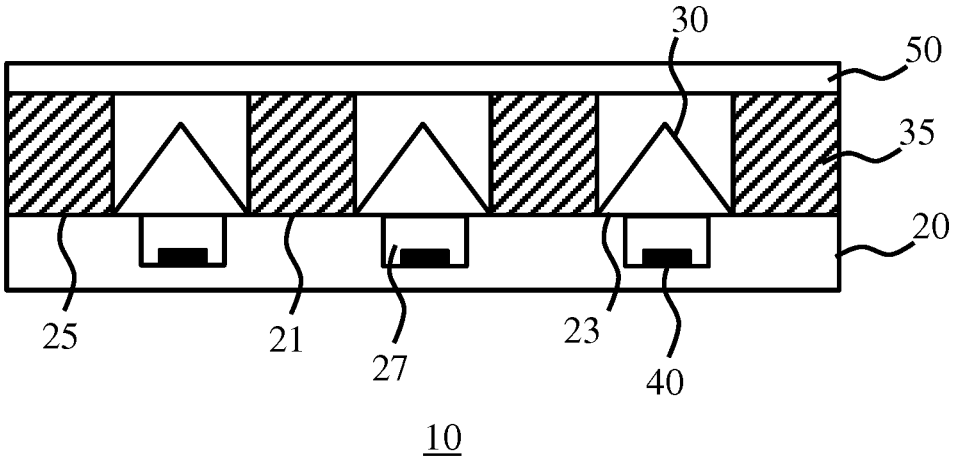
FIG. 3 schematically depicts a cross-sectional view of a lighting module according to another embodiment.

FIG. 3 schematically depicts a cross-sectional view of a lighting module 10 according to another example embodiment in which the carrier 20 comprises a plurality of cavities 27, each cavity 27 housing one or more light engines 40. The carrier 20 may be made of an acoustically absorbent material in this embodiment such that sound waves 22 penetrating the cavities 27 are also absorbed, thereby further improving the acoustic performance of the lighting module 10. In order to optimize the optical performance of the lighting module 10 in this embodiment, the internal surfaces or at least the sidewalls of each cavity 27 carries a light-reflective layer such as a white paint coating or a light reflective foil in order to increase the amount of light generated by the one or more light engines 40 exiting the cavity 27 and subsequently the lighting module 10 through its light exit structure 50.

Figure 4:
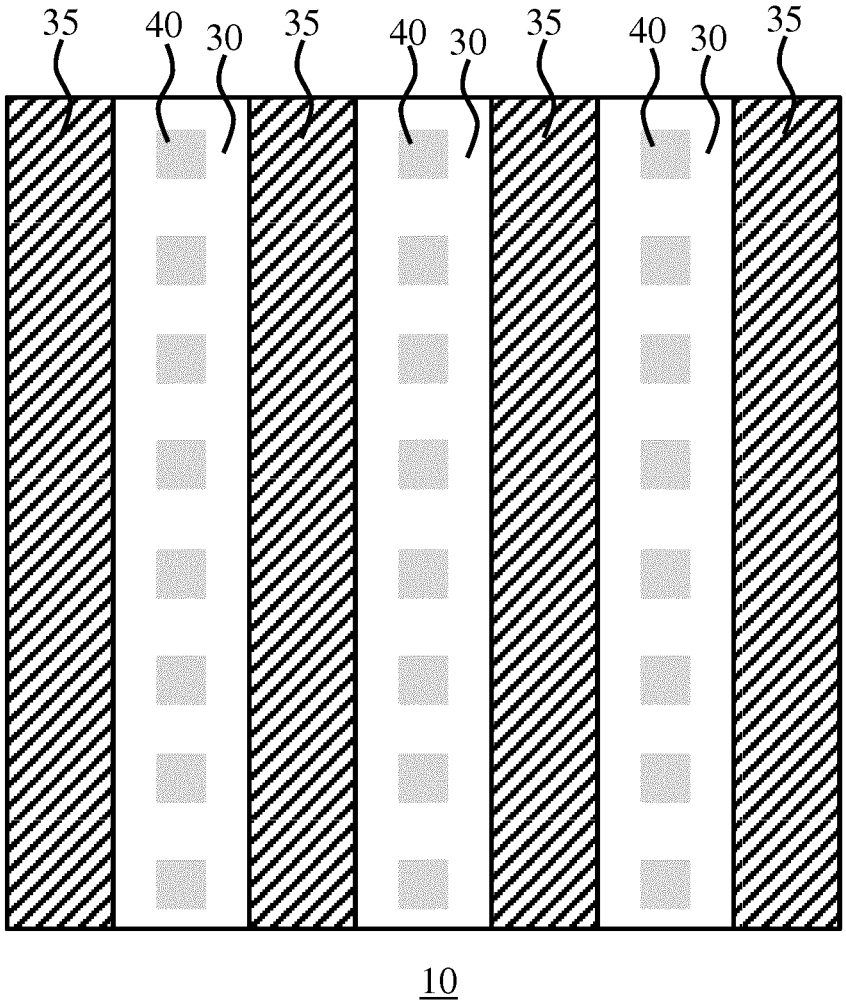
FIG. 4 schematically depicts a top view of a lighting module according to an embodiment.
Figure 5:
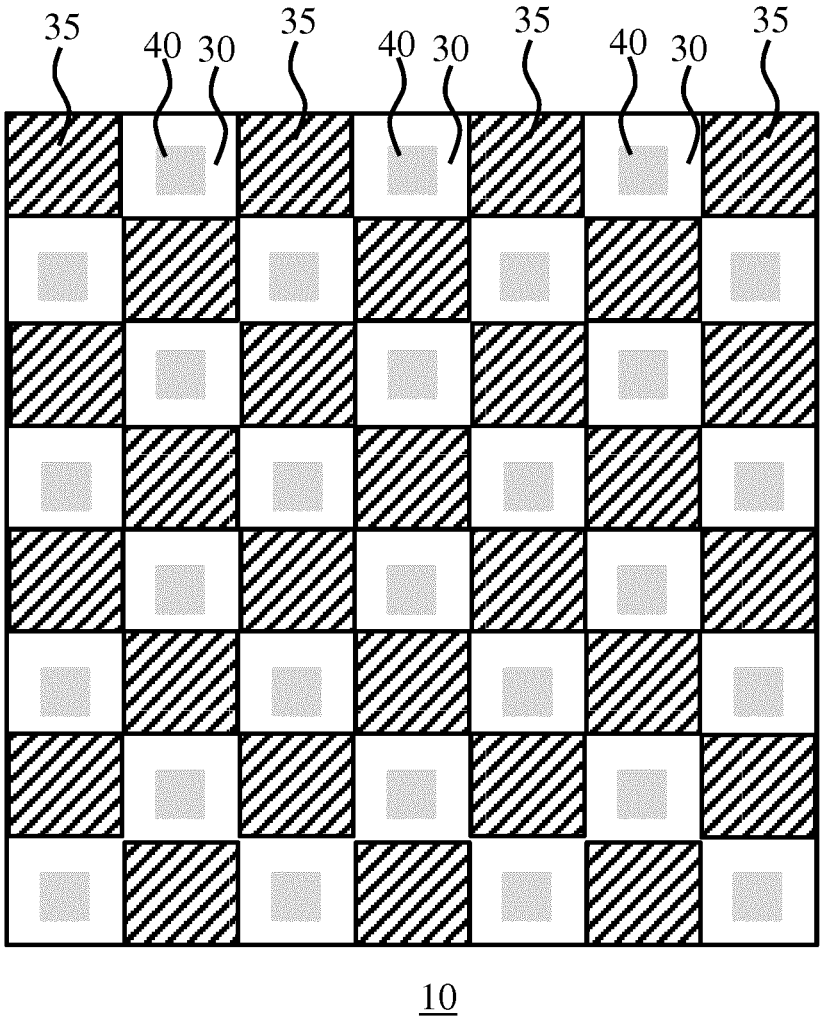
FIG. 5 schematically depicts a top view of a lighting module according to another embodiment.

The first regions 23 and the second regions 25 on the major surface 21 of the carrier 20 may define a regular pattern of regions, such as the striped or zebra pattern schematically depicted in FIG. 4, which shows a top view of a lighting module 10 through the light exit structure 50 (not shown) according to an example embodiment or the checkerboard pattern schematically depicted in FIG. 5, which shows a top view of a lighting module 10 through the light exit structure 50 (not shown) according to another example embodiment. Other regular patterns, e.g. a honeycomb pattern, a triangular pattern and so on, are of course equally feasible. As a further example, each first region 23 in the zebra pattern of FIG. 4 carries a plurality of light engines 40 covered by a common, elongate, light transmissive cover 30, with the zebra pattern comprising elongate first regions 23 alternated by elongate second regions 25 in which the acoustically absorbent members 35, e.g. bar-shaped members 35, are located to absorb the sound waves 33 directly incident thereon or reflected by the light transmissive covers 30 as previously explained. Alternatively, each light engine 40 may be covered by an individual light transmissive cover 30.

In the checkerboard pattern schematically depicted in FIG. 5, each first region 23 houses one light engine 40, wherein each light engine 40 is covered by its own light transmissive cover 30. Any suitable embodiment of the light transmissive cover 30 as previously described with the aid of FIG. 1 may be considered for this purpose. For example, the light transmissive cover 30 may be a pyramidally shaped cover that deflects incident sound waves 33 onto the acoustically absorbent members 35 in the second regions 25 adjacent to the first region 23 as previously explained.

Figure 6:
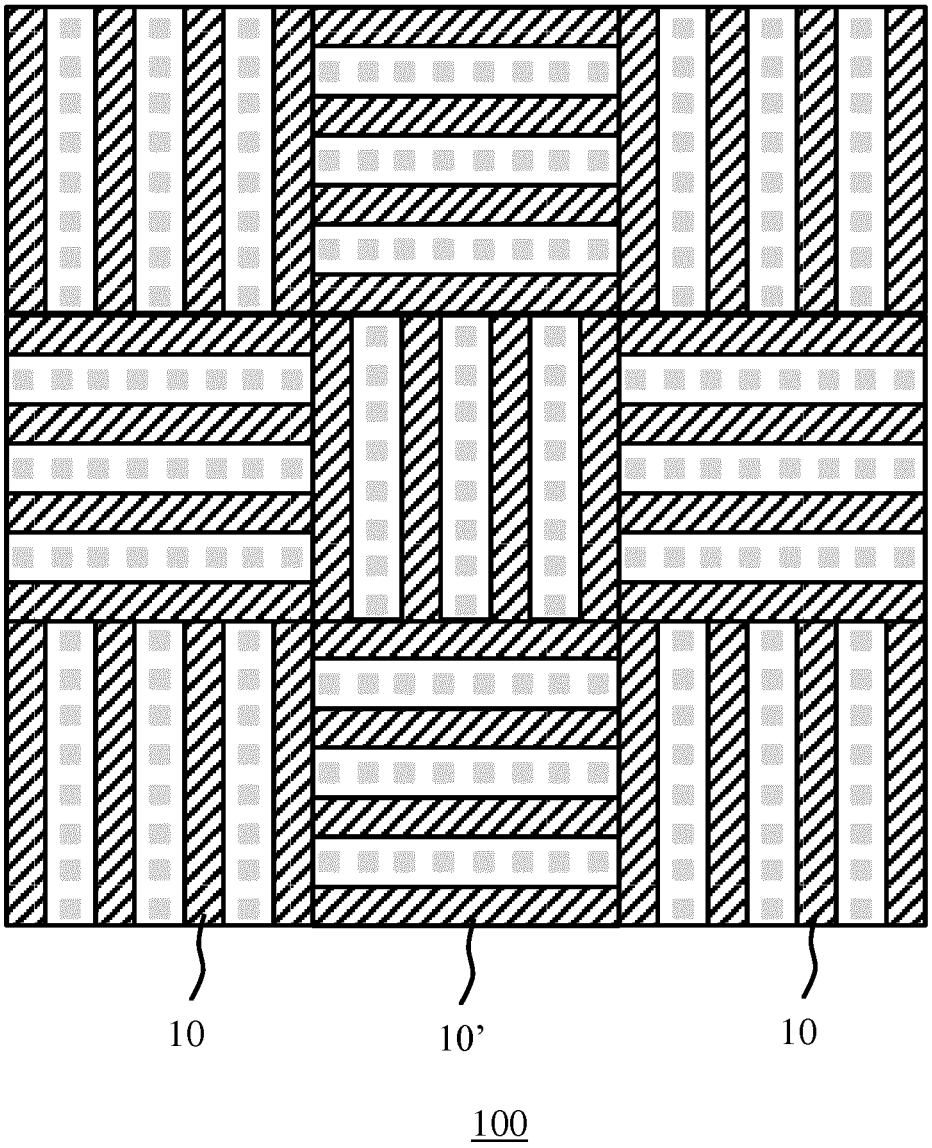
FIG. 6 schematically depicts a top view of a lighting assembly according to an example embodiment.

As previously explained, a plurality of lighting modules 10 may be provided as a lighting kit in which the lighting modules 10 can be assembled into a large area lighting apparatus. Where the lighting modules 10 comprise such a regular pattern as explained above, the thus assembled lighting apparatus has substantially homogenous sound absorbing characteristically across its surface area, in particular where identical lighting modules 10 have been used in the lighting kit. Alternatively, the lighting kit may comprise lighting modules 10 having different regular patterns such that the overall acoustic performance of the assembled large area lighting apparatus can be tuned by positioning of a lighting module 10 having a particular regular pattern within a particular location of the large area lighting apparatus.

Where such regular patterns are of a directional nature, such as for example in the case of the zebra pattern as schematically depicted in FIG. 4, the overall acoustic performance of the large area lighting apparatus assembled from such lighting modules 10 may be directionally dependent if the directional regular patterns of all the lighting modules 10 are aligned in the assembled large area lighting apparatus. In order to create directionally independent acoustic performance in such a large area lighting apparatus 100, an alternating pattern of lighting modules 10 as schematically depicted in FIG. 6 may be assembled in which each lighting module 10 having its directional pattern extending in a first direction, e.g. a vertical direction, neighbors lighting modules 10' having its directional pattern extending in a second direction perpendicular to the first direction, e.g. a horizontal direction such that the overall acoustic behavior of the large area lighting apparatus 100 becomes directionally independent.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting module comprising:

a carrier having a major surface; and an optically transmissive light exit structure facing the major surface and being spatially separated therefrom;

wherein the major surface of the carrier includes a plurality of first regions and a plurality of second regions, the plurality of first regions and the plurality of second regions being arranged in a checkerboard pattern on the major surface, and each second region being adjacent to a first region;

wherein each first region of said carrier has at least one light engine;

wherein each first region is covered by a separate cover that is optically transmissive and acoustically reflective;

wherein each cover has a pyramidal shape comprising a surface portion with a surface normal under a non-zero angle with the surface normal of the light exit structure so that it is shaped to reflect sound waves towards an adjacent second region; and wherein each second region of said carrier has an acoustically absorbent member arranged to absorb said reflected sound waves.

2. The lighting module of claim 1, wherein the acoustically absorbent member has a light-reflective coating.

3. The lighting module of claim 1, wherein the acoustically absorbent member comprises at least one of a foam material, glass wool and a micro-perforated member.

4. The lighting module of claim 1, wherein the carrier is made of an acoustically absorbent material.

5. The lighting module of claim 1, wherein each first region comprises an acoustically absorbent recess housing the at least one light engine.

6. The lighting module of claim 5, wherein the acoustically absorbent recess has a light-reflective inner surface.

7. The lighting module of claim 1, wherein the light exit structure is a cloth spanning the major surface.

8. A lighting kit comprising a plurality of lighting modules of claim 1, wherein the lighting modules are configured to be coupled to each other.

9. The lighting kit of claim 8, further comprising a cloth for spanning across the lighting modules when coupled together in order to obscure said lighting modules from direct view.

* * * * *